United States Patent [19]

Christianson

[11] Patent Number: 4,862,884

[45] Date of Patent: Sep. 5, 1989

[54] REGULATOR SECOND STAGE FOR SCUBA

[76] Inventor: Tony Christianson, 277 Grulla Court, Norco, Calif. 91760

[21] Appl. No.: 103,829

[22] Filed: Sep. 30, 1987

[51] Int. Cl.[4] ..... B63C 11/22

[52] U.S. Cl. ..... 128/204.26; 251/254

[58] Field of Search ..... 251/251, 252, 254; 128/204.26, 204.29

[56] References Cited

U.S. PATENT DOCUMENTS

| | | | |
|---|---|---|---|
| 1,722,401 | 7/1929 | Todd | 251/254 |
| 2,201,095 | 5/1940 | Kaufman | 251/254 |
| 2,642,256 | 6/1953 | Stebling | 251/252 |
| 4,029,120 | 6/1977 | Christianson | 251/251 X |
| 4,147,176 | 3/1979 | Christianson | 128/204.26 |
| 4,168,721 | 9/1979 | Mueller Jr. | 137/514.7 |
| 4,226,257 | 10/1980 | Trimbwalder | 137/514.7 X |

FOREIGN PATENT DOCUMENTS

| | | | |
|---|---|---|---|
| 0599129 | 3/1978 | U.S.S.R. | 137/71 |

*Primary Examiner*—A. Michael Chambers
*Assistant Examiner*—John C. Fox

[57] ABSTRACT

The regulator second stage for scuba incorporates a semi-balanced valve mechanism of high flow capacity which operates without significant influence from friction. The compression spring is suspended between two axially opposed pins to avoid friction producing contact with the housing walls. The valve mechanism is suspended between a dynamic seal and a lever assembly to avoid friction producing contact with the housing walls. The valve controlling lever rotates a ball bearing and collar mechanism in which ball bearings cooperate with notches to provide high mechanical advantage with very low friction. The diaphragm and exhaust valve cooperate to provide stable interaction which conserves breathing gas during all orientations of the regulator second stage.

13 Claims, 4 Drawing Sheets

REGULATOR SECOND STAGE FOR SCUBA

BACKGROUND OF THE INVENTION

1. Field of the Invention

The present invention is related to pressure regulators for breathing apparatus and, more particularly, to the regulator second stage of a self-contained underwater breathing apparatus (scuba).

2. Description of the Prior Art

The functional cycling of a scuba regulator is controlled by the respiratory effort of the diver. An ideal regulator requires very little effort to exactly provide for the diver's respiratory needs during any combination of work load and depth. However, various characteristics of the prior art prevent achievement of this ideal.

In a typical scuba, air or other breathable gas (hereinafter "air", "breathable gas" and "gas" will be used interchangeably) is supplied to a diver from a high pressure tank via a two stage pressure regulator. Typically, a filled high pressure tank holds air at a pressure in excess of 2,000 psi. The regulator first stage is connected to the tank valve and functions to reduce tank pressure to an intermediate pressure which is about 150 psi above ambient. The tank and first stage are, generally, carried as a unit on the diver's back. A flexible hose conduit conveys the intermediate pressure air from the regulator first stage to a regulator second stage. The regulator second stage opens into and is held by the diver's mouth.

Within a typical second stage, a normally closed valve is mechanically levered open to provide air flow when a diaphragm, which is exposed to ambient pressure, is pulled inward by the suction created as a result of the diver's inhalation effort. Whenever the diver stops breathing, or exhales, the diaphragm responds to the lack of inhalation induced suction by returning to its neutral position, thereby stopping the flow of gas. An exhaust valve is provided to permit exhaled gases to escape to ambient.

Diaphragms and exhaust valves must be designed to avoid detrimental interaction. A discussion of diaphragm and exhaust valve designs, and an inventive diaphragm and exhaust valve combination are disclosed in the inventor's U.S. Pat. No. 4,574,797 entitled Diaphragm and Exhaust Valve for Second Stage Regulators, issued Mar. 11, 1986. Another diaphragm and exhaust valve combination are disclosed in the inventor's U.S. Pat. No. RE 31,932 entitled Diaphragm Assembly for the Demand Regulator of a Breathing Assembly, reissued July 2, 1985. These patents are incorporated herein by reference.

The most common second stage valve design of the prior art is spring loaded to keep an unbalanced, downstream, intermediate pressure valve normally closed. The spring is designed to oppose the intermediate pressure force trying to push aside the seat. In addition, the spring must provide an extra force against the seat to assure a gas tight seal when closed.

Combinations of deep diving and strenuous activity can cause respiratory demands which exceed the flow capabilities of a regulator. Larger valves provide greater flow capacity. But larger unbalanced valves require stronger springs which are difficult to operate with low respiratory effort.

In a less common second stage valve design, the normally closed valve is balanced. In a balanced valve, the pressure force is negated and therefore does not work to either open or close the valve. A balanced second stage valve does not require a spring force to overcome the intermediate pressure force. The spring provides only the force needed to close the valve and maintain a gas tight seal. As a result, balanced valves can be sized larger to deliver higher flow rates without the penalty of a stronger spring.

But unbalanced, downstream second stage valves also double in function as safety relief valves. A safety relief valve is needed in the event that a malfunctioning first stage over pressurizes the intermediate pressure hose conduit. Balanced valves cannot function as safety relief valves. Consequently, an independent safety relief valve must be included in parallel with a second stage balanced valve.

Another variation of the balanced valve, which satisfies the need for a safety relief valve, is the semi-balanced, second stage valve. With this design, the valve is partially unbalanced just enough to open in the event of excessive intermediate pressure. The spring, consequently, must be increased in strength to compensate for the partial unbalance. As a compromise design for improved regulator performance, the semi-balanced valve retains the advantages of a balanced valve and avoids the need for an independent safety relief valve.

A number of inventive valve designs have been proposed in the prior art to improve the performance of scuba regulators. One such design is characterized by having a small mechanically levered pilot valve which controls the movement of a balanced, pressure assisted main valve. In this arrangement, the pilot valve will respond to very low inhalation effort. Consequently, the main valve, being power assisted by gas pressure, can be sized as large as desired. The inventor's U.S. Pat. No. 3,783,891 entitled Balanced Regulator Second Stage, issued Jan. 8, 1974; U.S. Pat. No. 4,076,041 entitled Pilot Valve Operated Demand Regulator for a Breathing Apparatus, issued Feb. 28, 1978; and U.S. Pat. No. 4,297,998 entitled Pilot Controlled Regulator Second Stage, issued Nov. 3, 1981 all disclose second stage valve mechanisms which utilize a pilot valve to control the movement of a pressure assisted main valve. Pilot and main valve designs significantly improve scuba regulator performance, but have proven costly to manufacture.

Another valve design is disclosed in U.S. Pat. No. 4,041,978 entitled Pressure Regulator for Breathing Apparatus, issued to Karl Leemann on Aug. 16, 1977. The Leemann regulator is a balanced valve with a venturi-like modification to the valve seat which assists opening in direct proportion to flow. The Leemann regulator suffers from unstable and low flow performance.

Yet another valve design is disclosed in U.S. Pat. No. 4,266,538 entitled Pressure Regulator, issued to Heinz Ruchti on May 12, 1981. The Ruchti regulator is an unbalanced valve which uses an adjustable linkage of high mechanical advantage to communicate movement of the diaphragm to the valve. High mechanical advantage is a desirable feature because less respiratory effort is required to operate the valve mechanism against a given spring load. However, the high mechanical advantage linkage in the Ruchti device has an undesirable shortened valve stroke which limits the distance the valve can open and, consequently, severely limits high flow performance.

All of the second stage designs of the prior art are subject to performance degradation due to mechanical friction. For example, friction occurs with sliding and rotary contact of the lever or linkage which communicates movement of the diaphragm to the second stage valve. Also, second stage valve seat assemblies and accompanying springs of the prior art typically rub against the valve housing during operation. These frictional forces must be overcome by respiratory effort and account for much of the effort needed to initiate flow.

During a respiratory cycle, the second stage valve must continuosly adjust output because flow into the lungs increases from zero (at the beginning of inhalation) to a maximum approximately half way into the breath, and back to zero as inhalation is completed. The transition from zero to maximum and back to zero flow should be smooth and uninterrupted. As the flow varies, frictional forces cause uneven or erratic operation of the regulator. Frictional forces also cause the valve to lag behind the actual demand, producing a hysteresis effect.

SUMMARY OF THE INVENTION

In view of the foregoing factors and conditions which are characteristic of the prior art, it is one objective of the present invention to provide an improved scuba second stage regulator with a valve mechanism which operates smoothly because frictional forces have been minimized.

It is another objective of the present invention to provide a semi-balanced valve mechanism of high flow capacity.

It is yet another objective of the present invention to provide a lever mechanism of high mechanical advantage.

It is still yet another objective of the present invention to provide an improved scuba second stage regulator with a diaphragm and exhaust valve combination which functions with stable interaction and which conserves breathing gas during any orientation of the diver.

In accordance with an embodiment of the present invention, an improved regulator second stage is described. The improved regulator second stage incorporates a semi-balanced valve mechanism of high flow capacity which operates without significant influence from friction. The compression spring is suspended between two axially opposed pins to avoid friction producing contact with the housing walls. The valve mechanism is suspended between a dynamic seal and a lever assembly to avoid friction producing contact with the housing walls. The valve controlling lever rotates a ball bearing and collar mechanism in which ball bearings cooperate with notches to provide high mechanical advantage with very low friction. The diaphragm and exhaust valve cooperate to provide stable interaction which conserves breathing gas during all orientations of the regulator second stage.

DESCRIPTION OF THE DRAWINGS

A detailed description of the invention is made with reference to the accompanying drawings wherein like numerals designate corresponding parts in the several figures.

DESCRIPTION OF THE PREFERRED EMBODIMENT

The following detailed description is of the best presently contemplated modes of carrying out the invention. This description is not to be taken in a limiting sense, but is made merely for the purpose of illustrating the general principles of the invention.

Figure 1:
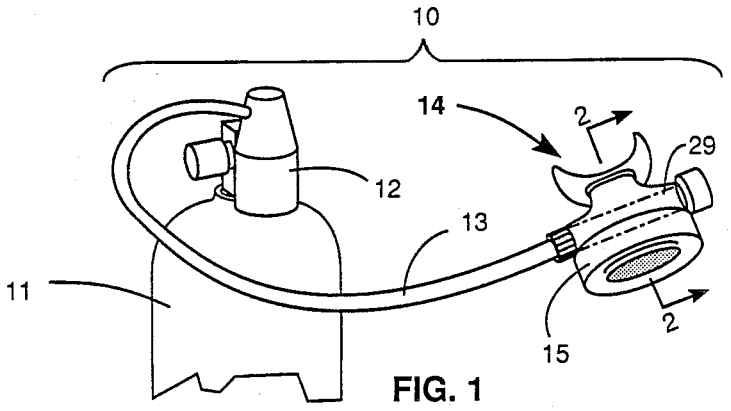
FIG. 1 is a pictorial view of a self-contained underwater breathing apparatus incorporating the improved regulator second stage.

Referring to FIG. 1, there is shown scuba regulator 10 attached to scuba tank 11. Tank 11 contains a breathable gas under high pressure, typically in excess of 2,000 psi. Regulator 10 comprises a regulator first stage 12, flexible hose conduit 13, and inventive regulator second stage 14. Regulator first stage 12 functions to reduce tank pressure to an intermediate pressure which is about 150 psi above ambient. Flexible hose conduit 13 provides the intermediate pressure gas to inventive regulator second stage 14. Inventive regulator second stage 14 is described in greater detail hereinafter.

Figure 2:
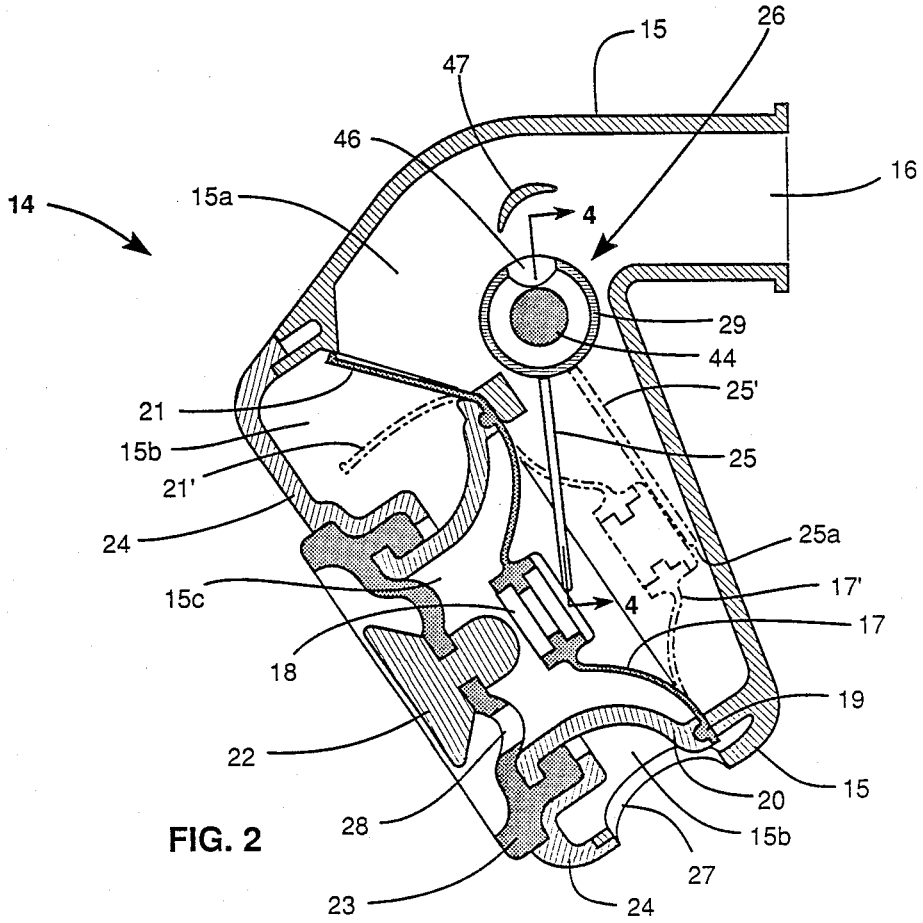
FIG. 2 is a transverse sectional view of the improved regulator second stage, as seen generally along the line 2—2 in FIG. 1, and which is pictured in the approximate position of use by an upward swimming skin diver looking horizontally forward.

Referring to FIG. 2, regulator second stage 14 has a generally cylindrical outer case 15 with mouthpiece opening 16. Second stage 14 advantageously incorporates within case 15 an assembly of diaphragm 17, diaphragm center 18, diaphragm seat 19, diaphragm retaining ring 20, exhaust valve 21, purge button 22, purge diaphragm 23, and cover 24 which are described in the inventor's U.S. Pat. No. 4,574,797. Diaphragm 17 is pictured in the neutral or "regulator off" position. Phantom line diaphragm 17' is the depressed or "regulator on" position. Correspondingly, whisker lever 25 of valve mechanism 26 (see FIG. 4) is pictured in the neutral position, and phantom line lever 25' is in the depressed position. Exhaust valve 21 is pictured in the closed position, and phantom line exhaust valve 21' is in the open or "exhalation" position.

Diaphragm 17 and exhaust valve 21 and related supporting structure partition the interior of case 15 into chambers **15*a* and 15*b*. Mouthpiece opening 16 communicates with chamber 15*a*. The bottom (when regulator second stage 14 is in the approximate position of use by an upward swimming skin diver looking horizontally forward) of outer case 15 has at least one opening 27 which admits ambient water into chamber 15***b*. Diaphragm retaining ring 20 separates diaphragm chamber 15*c* from chamber 15*b*. Purge diaphragm 23 has at least one opening 28 which admits ambient water into diaphragm chamber 15*c*.

Exhaust valve 21 is, typically, a flap of a resilient, highly flexible material, for example silicon elastomer or the like, which is restrained along one side in such a way that it can selectively flex from the opening which it covers. Phantom line 21' in FIG. 2 depicts the open or "exhaust" position. Exhaust valve 21 will flex to allow fluid flow in the direction from chamber 15*a* to chamber 15*b* only. Consequently, exhaust valve 21 operates as a check valve which prevents the reverse flow of ambient water from chamber 15*b* into chamber 15*a*.

FIG. 2 pictures regulator second stage 14 in the approximate position of use by an upward swimming skin diver looking horizontally forward. In this orientation, exhaust valve 21 is above diaphragm 17. Although ambient water is freely admitted into chamber 15*b* by opening 27, the unvented confinement of the upper portion of chamber 15*b* traps a bubble of air adjacent exhaust valve 21. The bubble of air in chamber 15*b* is pressurized by the ambient hydrostatic pressure at the level of opening 27. The pressure within chamber 15*a* is maintained at the ambient hydrostatic pressure at the level of diaphragm 17 (a detailed explanation is presented in the inventor's U.S. Pat. No. 4,574,797). Consequently, exhaust valve 21 is closed by the relatively higher pressure in chamber 15*b* and breathing gas will not inadvertently flow from chamber 15*a* to ambient.

Figure 3:
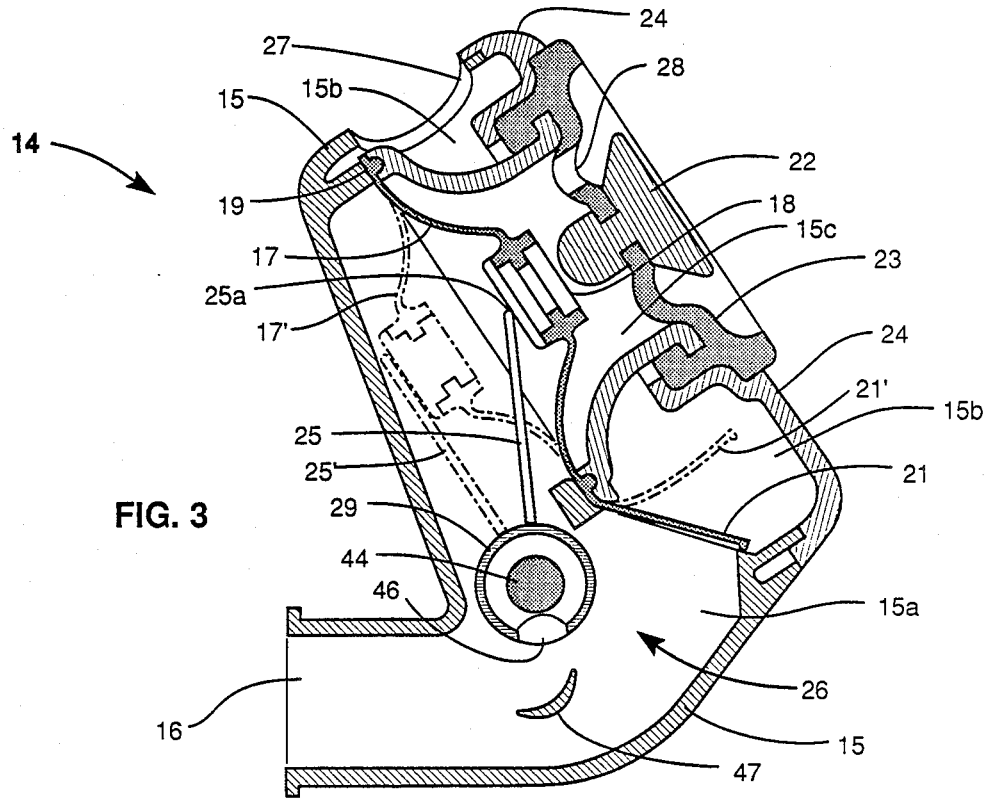
FIG. 3 is a transverse sectional view similar to FIG. 2, picturing the improved regulator second stage in the approximate position of use by an upside-down skin diver looking horizontally forward.

FIG. 3 pictures regulator second stage 14 in the approximate position of use by an upside-down (i.e. feet over head) skin diver looking horizontally forward. Oriented upside-down, water completely floods chamber 15*b* and the water side of exhaust valve 21 is exposed to ambient hydrostatic pressure at the level of the exhaust valve. Consequently, exhaust valve 21 is closed by the higher hydrostatic pressure (relative to the hydrostatic pressure against diaphragm 17) and breathing gas will not inadvertently flow from chamber 15*a* to ambient. Similarly, exhaust valve 21 will not inadvertently release breathing gas to ambient when regulator second stage 14 is at orientations intermediate of those pictured in FIGS. 2 and 3.

The diaphragm and exhaust valve arrangement of inventive regulator second stage 14 provides a distinct advantage over prior art regulator second stages which place the exhaust valve below the diaphragm, vented directly to ambient, when the regulator second stage is in the approximate position of use by an upward swimming skin diver looking horizontally forward. The prior art arrangement allows a wasteful, continuous release of breathing gas whenever a sensitive regulator is oriented so that the exhaust valve is above the diaphragm. Loss of breathing gas is very undesirable because the diver carries a limited supply of gas.

Figure 4:
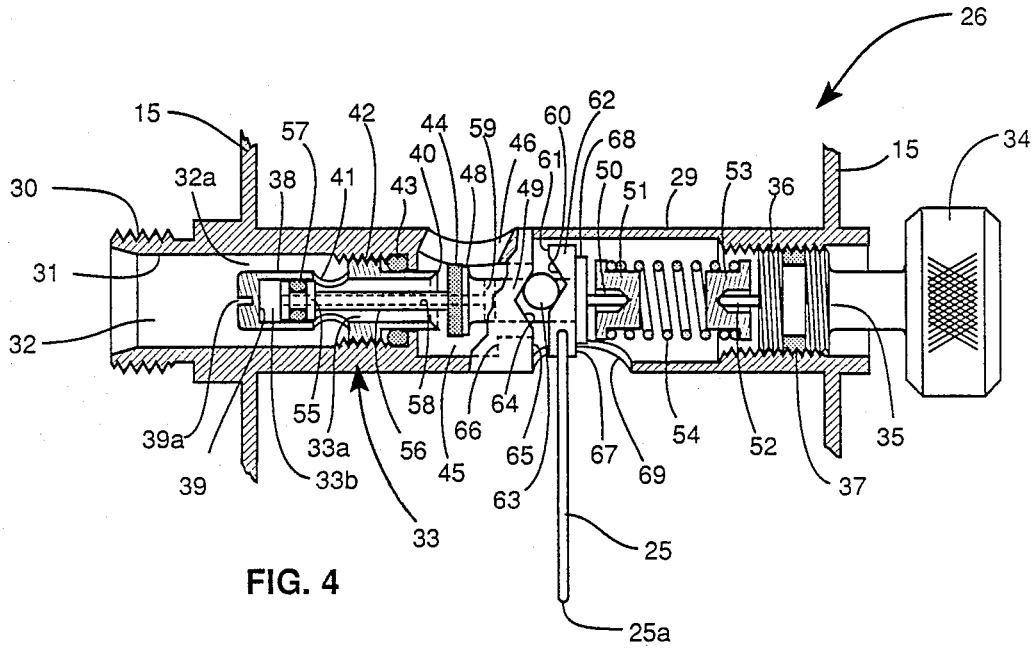
FIG. 4 is a sectional view of the improved regulator second stage valve mechanism with the valve open, as seen generally along the line 4—4 in FIG. 2.
Figure 5:
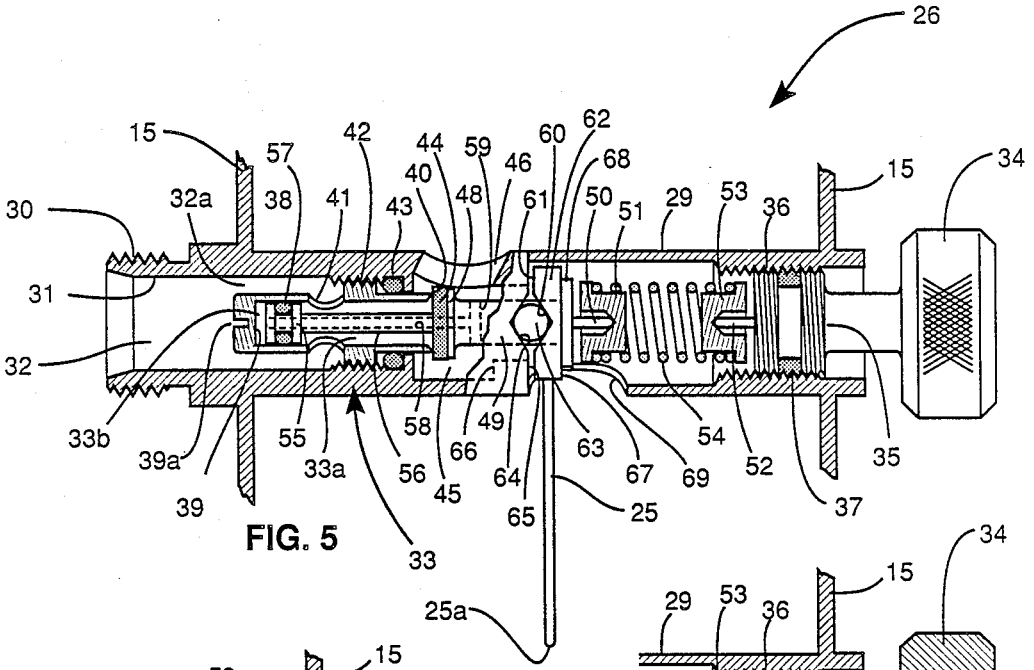
FIG. 5 is a sectional view of the improved regulator second stage valve mechanism pictured in FIG. 4, with the valve closed.

Referring to FIGS. 4 and 5, second stage valve mechanism 26 is contained within tubular housing 29. Tubular housing 29 transverses case 15 (see FIG. 1) near mouthpiece opening 16 (see FIG. 2). Threaded coupling 30 at one end of housing 29 protrudes beyond case 15 (see FIG. 2) to receive hose conduit 13 (see FIG. 1) and with cylindrical inside wall 31 forms inlet chamber 32 leading to valve member 33. External adjustment knob 34 includes threaded stem 35 which engages internal threads 36 at the other end of housing 29. Seal 37, for example an O-ring, is included on stem 35 and prevents the communication of fluids past threads 36.

Valve member 33 is formed by cylindrical wall 38 having a closed end 39 and an open end having edge 40. The outside diameter of wall 38 is sized to provide clearance for substantially unrestricted flow of intermediate pressure gas through annular portion 32*a* of inlet chamber 32 defined by and between cylindrical walls 31 and 38. Breathable gas flows from inlet chamber 32 to valve chamber 33*a* via one or more holes 41 through wall 38. Threaded flange 42 concentrically joins walls 31 and 38. Seal 43 prevents the leakage of gas past threaded flange 42. Thus, gas from conduit 13 passes through inlet chamber 32, annular chamber 32*a*, holes 41 and valve chamber 33*a*.

Edge 40 cooperates with seat 44 to form a seat valve for the intermediate pressure breathable gas in chamber 33*a*. Seat 44 may be resilient, flexible rubber or plastic. The seat valve closes when edge 40 fully engages seat 44. Typically, this occurs when edge 40 presses into and slightly deforms the resilient, flexible surface of seat 44 such that minute surface imperfections between the edge and seat are filled. The sharpness of edge 40 determines the ease with which edge 40 deforms and seals with the surface of seat 44. However, edge 40 should be slightly blunted to preclude cutting seat 44.

As shown in FIG. 4, gas passing out of valve chamber 33*a* at edge 40 flows into outlet chamber 45 and, subsequently, out aperture 46 through the wall of chamber 45. Aperture 46 is oriented to direct the flow of breathable gas within case 15 toward mouthpiece opening 16 (see FIG. 2). Deflector 47 (see FIG. 2) facilitates directing flow into mouthpiece opening 16. Chamber 45 and aperture 46 are sized to provide substantially unrestricted flow past edge 40.

Seat 44 is bonded or otherwise joined to end 48 of generally cylindrical shuttle 49. The opposite end of shuttle 49 incorporates axial pin 50 to pivotally engage the center of hat-shaped spring retainer 51. Similarly, the inside end of stem 35 incorporates axial pin 52 to pivotally engage the center of spring retainer 53. Spring 54 is suspended in compression between spring retainers 51 and 53 by pins 50 and 52.

The compressive force of spring 54 is transmitted via shuttle 49 to seat 44, urging seat 44 against edge 40. Spring 54 is sized to oppose the intermediate pressure force of the gas in chamber 33*a* trying to push seat 44 away from edge 40. In addition, spring 54 also provides the deforming force against seat 44 which assures a sealed closure with edge 40.

External adjustment knob 34 can precisely adjust the compression of spring 54 and the force applied thereby for sealing seat 44 against edge 40. Adjustment is accomplished by first rotating knob 34 outward, which reduces the compression of spring 54, until leakage of gas around edge 40 is detected. Knob 34 is next rotated inward until the leakage just stops, which denotes that spring 54 is applying exactly enough force to counter the intermediate pressure in valve chamber 33*a* to provide a gas tight closure.

During the course of a dive, external adjustment knob 34 can be used by the diver to change the inventive regulator's inhalation sensitivity. The adjustment knob should normally be adjusted to provide maximum sensitivity. During special circumstances the regulator can be temporarily "detuned" by screwing knob 34 inward. For example, when working vertically head down, the regulator can be detuned to ease uncomfortable overpressure in the lungs. Also when snorkeling with the regulator unattended, or when diving with a backup regulator, the unattended regulator(s) can be temporarily detuned to greatly reduce inadvertent loss of air.

Piston 55 in valve member 33 is connected to shuttle 49 by shaft 56. Shaft 56 passes through the center of seat 44. Piston 55 divides the interior of valve member 33 into chambers 33*a* and 33*b*. Chamber 33*a* is between piston 55 and edge 40. Chamber 33*b* is between piston 55 and closed end 39. Dynamic seal 57 cooperates with piston 55 to prevent the communication of pressure between chambers 33*a* and 33*b*.

Small diameter passage 58 passes through the axial center of piston 55 and shaft 56 and partially through the axial center of shuttle 49. Passage 58 intersects with cross passage 59 which passes radially through shuttle 49. The gas in outlet chamber 45 is, thus, communicated via passages 58 and 59 to chamber 33*b* and determines the pressure therein.

Intermediate gas pressure in chamber 33*a* pushes seat 44 toward outlet chamber 45, forcing it away from edge 40. Because the pressure in chamber 33*b* is the same as that in outlet chamber 45, intermediate pressure in chamber 33*a* also pushes in the opposite direction against piston 55 which, because of joining shaft 56, counters the pressure force against seat 44. The seat valve formed by the cooperation of edge 40 with seat 44 is "pressure balanced" when the pressure area bounded by edge 40 exactly matches the pressure area acting against piston 55. Because the valve is pressure balanced, spring 54 can be sized to provide a substantially smaller, easier to control, force against seat 44.

Advantageously, to gain the benefit of a safety relief valve function, the valve is semi-balanced by slightly reducing the pressure area acting against piston 55 relative to the pressure area bounded by edge 40. For the semi-balanced configuration, the compressive force of spring 54 is increased to compensate for the partial pressure unbalance.

Notch 60 on face 61 of circular collar 62 holds ball bearing 63 against a similarly placed notch 64 on face 65 of housing internal flange 66. Opposite face 67 of collar 62 bears against and holds concentric shuttle flange 68. Rotational movement of collar 62 relative to housing 29 will force collar 62 to separate from flange 66 because ball bearing 63 will be forced to roll up the sides of the opposing notches as shown in FIG. 4. The movement of collar 62 away from flange 66 is transmitted via shuttle 49 to move seat 44 away from edge 40. Of course, a plurality of ball bearings mounted in a like plurality of equally spaced notches can be included in the apparatus, if desired.

Referring to FIG. 5, seat 44 should seal against edge 40 when ball bearing 63 is fully engaged with notches 60 and 64. That is, when ball bearing 63 is positioned at the vertex of notches 60 and 64 so that faces 61 and 65 are closely spaced. The distance between edge 40 and face 65 determines the degree of engagement. This distance can be adjusted by rotating valve member 33 along the threads of threaded flange 42. This adjustment is facilitated by screwdriver slot 39*a* which is accessible through inlet chamber 32 when hose conduit 13 (see FIG. 1) is not attached. Adjustment is accomplished by first rotating valve member 33 outward, which brings opposing notches 60 and 64 closer together, until leakage of gas around edge 40 is detected. Valve member 33 is next rotated inward until the leakage just stops, which denotes that ball bearing 63 is completely engaged with notches 60 and 64 at the exact distance of sealed closure.

A special tool can be designed to adjust member 33 with the inventive regulator second stage pressurized. Without the special tool, the adjustment is made by removing hose conduit 13, fractionally turning slot 39*a* with a screwdriver, attaching the hose and repressurizing. This procedure is repeated as often as necessary to achieve the desired setting.

Whisker lever 25 is an extension of collar 62 and protrudes from the side of housing 29 through lever opening 69 to make contact with diaphragm center 18 as shown in FIG. 2. Inward movement of diaphragm 17 is transmitted via diaphragm center 18 and lever 25, forcing collar 62 to rotate. The material of diaphragm center 18 is chosen to minimize the friction of sliding contact with tip 25*a* of lever 25. For example, a fluorocarbon plastic dispersed in acetal resin, or the like, can be utilized. Rotation of collar 62 separates seat 44 from edge 40, enabling the flow of gas past edge 40 into chamber 45 and, subsequently, out aperture 46.

The mechanical advantage of the lever mechanism is determined by the length of lever 25, the shape of the notches 60 and 64, and the diameter of ball bearing 63. For a straight sided "V" shaped notch, the relationship is:

$$a = l/d(\tan 0.5\phi)$$

where:

a = mechanical advantage
l = lever length
d = ball bearing diameter
$\phi$ = included angle of notch These dimensions are primarily dictated by the desired size of the regulator second stage. For a typically sized second stage, a lever length of 3.5 cm, a "V" shaped notch of 120° included angle, and ball bearing diameter of 3.9 mm are reasonable dimensions. These dimensions produce a fixed mechanical advantage of 16. Lever mechanisms in regulator second stages of the prior art typically have mechanical advantages of 8 to 10.

Similarly, the distance the seat valve opens is determined by the swing of lever 25, the shape of notches 60 and 64, and the diameter of ball bearing 63. For a straight sided "V" shaped notch, the relationship is:

$$x = (\pi d\beta/180)\tan(90 - \phi/2)$$

where:

x = distance valve opens
$\beta$ = swing of lever
d = ball bearing diameter
$\phi$ = included angle of notch For a lever swing of 30°(typical for the size constraints of the inventive regulator), a "V" shaped notch of 120° included angle, and a ball bearing diameter of 3.9 mm, the valve opens 1.18 mm which is ample for high flow performance.

Spring 54 is suspended in compression between spring retainers 51 and 53 by pins 50 and 52. Because spring 54 does not make contact with housing 29, spring 54 operates without friction. Piston 55, shaft 56, seat 44, and shuttle 49 are suspended as a unit between dynamic seal 57 and collar 62. The total mechanical frictional forces which come into play during operation of the valve mechanism are generated by lever tip 25*a* sliding along diaphragm center 18, dynamic seal 57 sliding along wall 38, and collar 62 rotating on ball bearings 63. These frictional forces are relatively small and do not contribute significantly to the respiratory effort required to operate the inventive regulator second stage.

Figure 6:
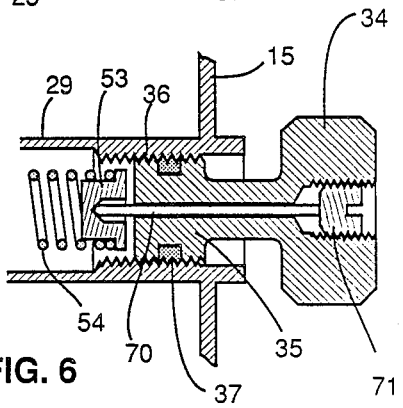
FIG. 6 is a sectional view of a portion of the improved regulator second stage valve mechanism picturing an alternate adjustment means.

Variations of the components described above are contemplated. For example, referring to FIG. 6, elongated axial pin 70 cooperates with set screw 71 to facilitate the adjustment range of knob 34. That is, by adjusting set screw 71 in or out within knob 34, a fine tuning of the adjustment can be made.

Figure 7:
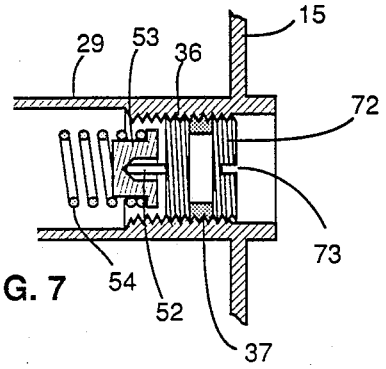
FIG. 7 is a partially sectioned, partially broken away view of the improved regulator second stage valve mechanism picturing another alternate adjustment means.

Referring to FIG. 7, threaded adjustment plug 72 is shown in place of knob 34 and stem 35. Plug 72 is adjusted via screwdriver slot 73 in a like manner above described for knob 34. Use of plug 72 precludes external adjustment by a diver during the course of a dive.

Figure 8:
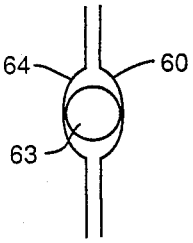
FIGS. 8, 9, 10 and 11 are each views of alternate linkage configurations.
Figure 9:
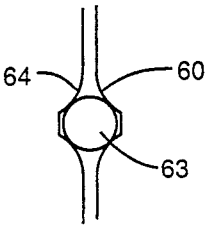
Figure 10:
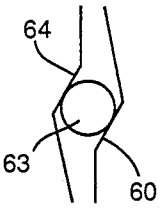

Referring to FIGS. 8, 9 and 10, there are shown alternate contours for notches 60 and 64. The notch of FIG. 8 is a concave contour which provides a variable mechanical advantage which is initially high. The notch of FIG. 9 is a set of convex contours which provide a variable mechanical advantage which is initially low. The contour of FIG. 10 is an alternate configuration for an elongated, substantially straight sided notch of fixed mechanical advantage.

Figure 11:
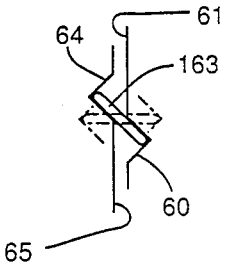

Referring to FIG. 11, there is shown an alternate linkage configuration in which rotating member 163 replaces ball bearing 63. Member 163 is, typically, a rectangular flat plate having opposite sides adapted to pivot in the vertices of notches 60 and 64. For the configuration of FIG. 11, valve closure (minimum spacing between faces 61 and 65) occurs when notches 60 and 64 are staggered as shown. The phantom lines of FIG. 11 shown the relative positions of the components when the valve mechanism is "open".

Figure 12:
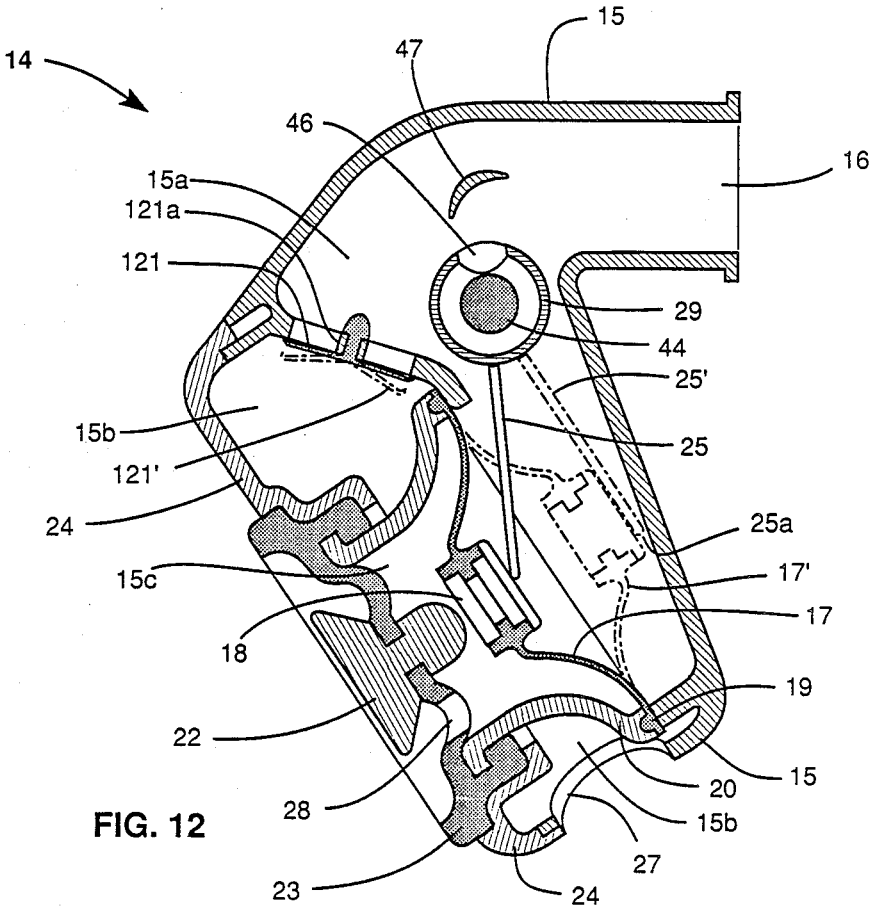
FIG. 12 is a transverse sectional view similar to FIG. 2, picturing an alternate exhaust valve configuration.

The preferred configuration of inventive regulator second stage 14 incorporates a combined, unitary diaphragm and exhaust valve member as described in the inventor's U.S. Pat. No. 4,574,797. FIG. 12 pictures an alternate configuration in which exhaust valve 121 is a separate component. Exhaust valve 121 is, typically, a flat disk of a resilient, highly flexible material, for example silicon elastomer or the like, which is centrally restrained in such a way that its unrestrained peripheral edge can selectively flex (depicted as phantom line 121' in FIG. 12) from the opening which covers. For example, the flexible disk can include a central, axial, mushroom shaped protuberance which engages central aperture 121*a* of a supporting web or spider interposed in the opening between chambers 15*a* and 15*b*. The exhaust valve will flex to allow fluid flow in the direction from chamber 15*a* to chamber 15*b* only. Consequently, exhaust valve 121 will prevent the reverse flow of ambient water into chamber 15*a*.

Figure 13:
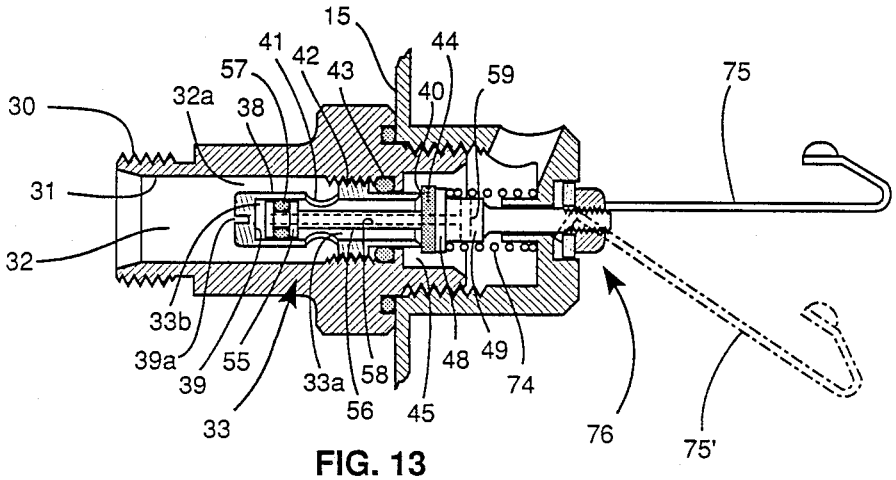
FIG. 13 is a transverse sectional view of a regulator second stage valve mechanism which incorporates inventive valve components with spring and linkage components of the prior art.

Inventive balanced valve components of inventive regulator second stage 14 can be combined with a prior art spring linkage assembly. FIG. 13 pictures valve member 33, shuttle 49, piston 55 and related structure with prior art configured spring 74, prior art lever 75 and prior art adjustment means 76. Lever 75 is pictured in the neutral or "regulator off" position. Phantom line lever 75' is in the depressed or "regulator on" position. This arrangement provides a regulator second stage with the benefits of a balanced valve.

The present invention is shown and described as part of an underwater breathing apparatus, but inventive regulator second stage 14 can be used in other applications requiring breathing apparatus, for example, fire fighting equipment.

It is understood that those skilled in the art may conceive of other applications, modifications and/or changes to the invention described above. Any such applications, modifications or changes which fall within the purview of the description are intended to be included therein as well. This description is intended to be illustrative and is not intended to be limitative. The scope of the invention is limited only by the scope of the claims appended hereto.

Intending to claim all novel, useful and unobvious features shown or described, I claim:

1. A demand valve of a breathing apparatus regulator, the improvement comprising:

a housing means having an inlet and an outlet;

said housing inlet adapted to receive pressurized gas;

conduit means mounted within said housing means and adapted to communicate between said inlet and outlet;

valve means mounted adjacent one end of said conduit means to selectively interrupt communication between said inlet and outlet;

forcing means associated with said valve means to selectively cause said valve means to interrupt communication between said inlet and outlet;

control means associated with said valve means and operative to selectively counter said forcing means;

said control means includes a collar means having at least one notch therein;

said housing means having at least a surface therein which includes at least one notch therein which is the complement of the notch in said collar means; and rotating means intermediate said surface and said collar means and within said notches.

2. The regulator device recited in claim 1 including:

lever means extending radially outwardly from said collar means and through an opening in said housing means whereby movement of said lever means causes said collar means to rotate around the axis thereof so that said rotating means interacts with said notches and causes said collar means to move axially relative to said surface in said housing means.

3. The regulator device recited in claim 2 wherein:

said collar means is connected to said valve means whereby axial movement of said collar means relative to said housing means effects the operation of said valve means relative to said conduit means.

4. The regulator device recited in claim 2 including:

case having an interior chamber;

said case having an opening for respiratory flow communicating with said interior chamber;

diaphragm means flexibly responsive to respiration induced pressure differences between said interior chamber and ambient; and said diaphragm means is operatively mounted relative to said lever means to control movement of said lever means.

5. The regulator device recited in claim 1 wherein:

said housing means comprises a tube member with said inlet included at one end thereof and said outlet included in the side of said tube member.

6. The regulator device recited in claim 1 wherein:

said conduit means comprises a tubular member mounted coaxially within said housing means;

said conduit means having an open end and a closed end;

said open end comprising said one end adjacent said valve means; and at least one aperture formed through said tubular member adjacent said closed end thereof.

7. The regulator device recited in claim 6 including:

sealing means interposed between said housing means and said conduit means;

said sealing means disposed intermediate said inlet and said outlet of said housing means thereby to form inlet and outlet chambers within said housing means; and said sealing means disposed intermediate said open end and said closed end of said conduit means whereby said closed end of said conduit means and each aperture adjacent thereto resides in said inlet chamber and said open end of said conduit means resides in said outlet chamber whereby said inlet chamber can selectively communicate with said outlet chamber only via said conduit means.

8. The regulator device recited in claim 6 wherein:

said valve means includes a piston means which extends axially into said conduit means interposed between said aperture and said closed end of said conduit means, and forms a conduit chamber between said piston and said closed end of said conduit means; and said piston means includes a shaft with an axial bore therethrough which communicates with said conduit chamber.

9. The regulator device recited in claim 8 wherein:

said valve means includes a shuttle means which extends axially in said housing means at the opposite side of said valve means relative to said piston means; and said shuttle means having a bore therethrough which communicates with the axial bore in said shaft and with said outlet chamber whereby said outlet chamber communicates with said conduit chamber.

10. The regulator device recited in claim 9 wherein:

said forcing means includes compression spring means for applying axial force to said valve means via said shuttle means.

11. The regulator device recited in claim 10 including:

external adjustment means comprising a threaded adjustment means which is adapted to be threadedly moved relative to said housing means in order to position said compression spring means relative to said valve means thereby to adjust the force applied to said valve means via said shuttle means.

12. The regulator device recited in claim 11 wherein:

said threaded adjustment means includes a knob attached thereto for manually turning said threaded adjustment means for threaded movement relative to said housing means.

13. The regulator device recited in claim 10 including:

retainer means for axially supporting the opposite ends of said compression spring means in suspended, pivotal relationship to said shuttle means and said adjustment means, respectively.

* * * * *